United States Patent [19]

Jaeggi

[11] 3,998,165

[45] Dec. 21, 1976

[54] BALLAST TAMPING TOOL UNIT

[75] Inventor: Hans Peter Jaeggi, Dulliken, Switzerland

[73] Assignee: Franz Plasser Bahnbaumaschinen-Industriegesellschaft m.b.H., Vienna, Austria

[22] Filed: Apr. 7, 1975

[21] Appl. No.: 565,339

[30] Foreign Application Priority Data

Apr. 8, 1974 Germany ..... 2417062

[52] U.S. Cl. ..... 104/12

[51] Int. Cl.[2] ..... E01B 27/16

[58] Field of Search ..... 104/12, 10, 11, 13, 104/14; 404/133; 74/116

[56] References Cited

UNITED STATES PATENTS

| | | | |
|---|---|---|---|
| 1,663,922 | 3/1928 | Robin et al. | 74/116 X |
| 2,791,971 | 5/1957 | Schnellmann | 104/12 |
| 3,372,651 | 3/1968 | Plasser et al. | 104/12 |
| 3,621,786 | 11/1971 | Joy | 104/12 |
| 3,669,025 | 6/1972 | Plasser et al. | 104/12 |
| 3,735,708 | 5/1973 | Plasser et al. | 104/12 |

*Primary Examiner*—Robert J. Spar
*Assistant Examiner*—Randolph A. Reese
*Attorney, Agent, or Firm*—Kurt Kelman

[57] ABSTRACT

A tamping tool unit for a ballast tamping machine comprises a pair of reciprocatory tamping tools pivotally supported on axles which are rotatable in eccentric bearing bushings rotatably mounted on the axles. Rotation of the eccentric bearing bushings imparts a compound motion to the tamping tools consisting of a vertical and a horizontal component.

6 Claims, 7 Drawing Figures

BALLAST TAMPING TOOL UNIT

The present invention relates to improvements in a tamping tool unit for a ballast tamping machine, which comprises a pair of tamping tool holders, drive means for pivoting the tamping tool holders towards and away from each other, and an axle pivotally supporting each tamping tool holder for their reciprocating movement.

Conventional tamping tool units comprise pairs of cooperating tamping tools which are immersed into the ballast, with a tie interposed therebetween, reciprocation of the tools towards each other causing the ballast between the tool jaws and underneath the tie to be tamped. In such units, a vibratory movement is superimposed on the tools during their tamping movement to impart a horizontal vibratory motion to the tamping tools during their tamping or closing motion. This transmits vibration to the ballast during tamping and increases the tamping efficiency. The tamping tools are lowered during the tamping operation to immerse the tamping tool jaws in the ballast and to enable them to tamp the ballast underneath the ties. The power required for this downward movement is considerable to enable the tamping tool jaws to penetrate into the ballast, particularly when the ballast is encrusted. This makes it necessary to make the tamping machine very heavy to prevent the machine from being lifted off the track when the tamping tool jaws are lowered into the ballast.

It is the primary object of this invention to provide a tamping tool unit of the above-described type which requires less power for penetration of the tamping tools into the ballast.

This and other objects and advantages are accomplished in accordance with the invention by rotatable mounting an eccentric bearing bushing on the axle pivotally supporting each tamping tool holder and providing further drive means for rotating the bearing bushing. This produces a compound motion consisting of a vertical and a horizontal component imparted to each tamping tool carrier. The vertical component facilitates the penetration of the tamping tools into the ballast.

The above and other objects, features and advantages of the present invention will become more apparent from the following description of now preferred embodiments of this invention, taken in conjunction with the accompanying drawing wherein FIG. 1 is a front elevational view of one embodiment of a tamping tool unit according to this invention;

FIG. 2 is a side elevational view of the tamping tool unit of FIG. 1, partly in section;

FIG. 3 schematically illustrates the operating principle of a tamping tool holder of the unit of FIG. 1;

FIG. 4 similarly shows the operating principle of a tamping tool holder of another embodiment;

Figure 2:
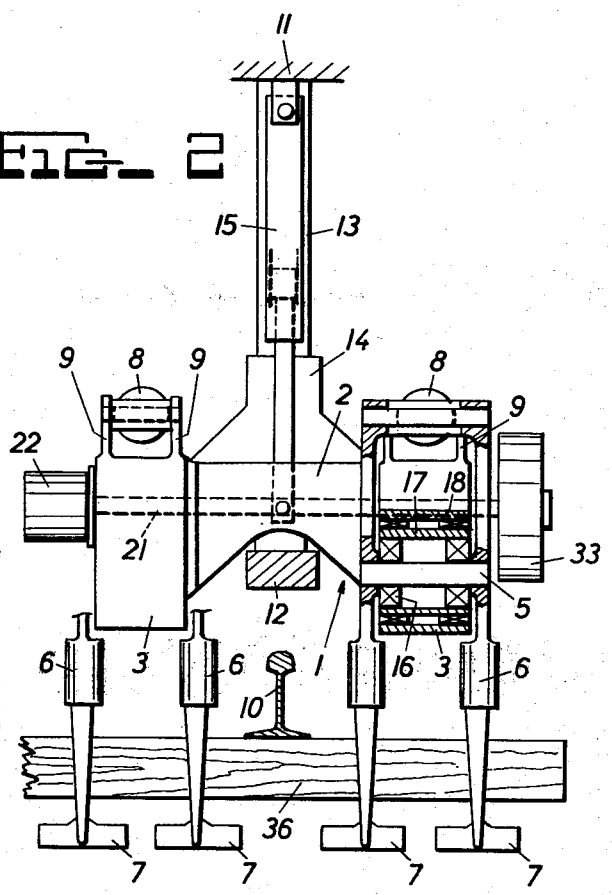
Figure 1:
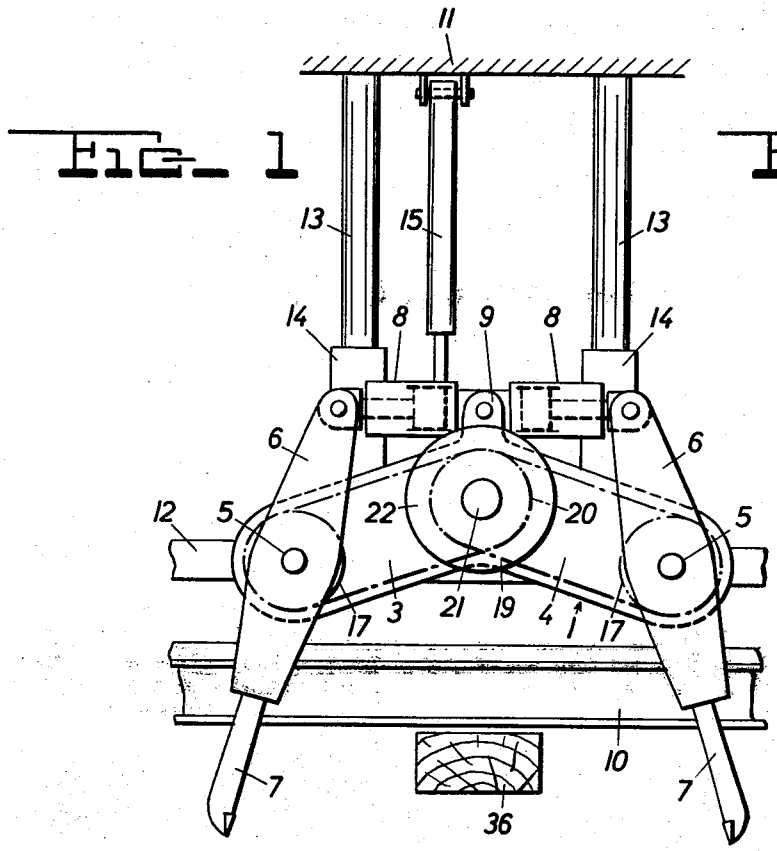

Referring now to the drawing and first to the embodiment shown in FIGS. 1 and 2, the illustrated tamping tool unit comprises housing 1 which is H-shaped, as view from above, transverse center portion 2 of the housing being visible in the side elevational view of FIG. 2. The outer ends of legs 3 and 4 of the H-shaped housing carry pivotal axles 5, 5 for tamping tool holders 6, the axles being mounted in the housing walls, as best shown in the sectioned portion of FIG. 2. As shown, the ends of pivotal axle 5 extend beyond the housing walls, and receive holders 6 for tamping tool jaws 7 replaceably mounted in the holders. The tamping tool holders are preferably rigidly affixed to their pivotal axles so as to be pivotal therewith. The tamping tool unit comprises eight tamping tools for effective tamping of ballast underneath ties 36 and, more particularly, the points of intersection between the ties and rail 10.

The pivoting axis for each tamping tool extends in a direction transverse to the rails intermediate an upper end of the tool carrier and the tamping jaw mounted in the carrier, hydraulic motors 8, 8 being fixedly mounted on flanged supports of housing 1 (see FIG. 2) and having the outer ends of their piston rods linked to the upper ends of the tamping tool holders. Pairs of such hydraulic motors extend in the direction of the rails between respective pairs of tamping tool holders 6, 6 so that, upon actuation of the hydraulic motors, the two pairs of tamping tools mounted on the housing are pivoted about axes defined by axles 5, 5 in relation to housing 1 whereby the tamping tools of each pair are reciprocated in the direction of the rails. This general type of ballast tamping action is quite conventional.

The tamping tool unit is mounted on a mobile track tamper mounted for mobility on rails 10 of the track, only lower frame portion 12 and upper frame portion 11 of the mobile tamper being visible in the drawing since all of this structure is conventional. Vertical guide columns 13, 13 interconnect the lower and upper machine frame portions, and guide sleeves 14, 14, which are affixed to housing center portion 2, guide housing 1 of the tamping tool unit vertically along the columns. Hydraulic motor 15 has one part linked to upper frame portion 11 while the other part of the hydraulic motor is linked to center portion 2 so that the tamping tool unit may be vertically reciprocated on the frame.

As shown in the sectioned part of FIG. 2, pivotal axle 5 is journaled in two anti-friction bearings 16, 16 and anti-friction bearings 18, 18 mount eccentric bearing bushing 17 in the end of each housing leg 3, 4.

Ball and roller bearings are satisfactory anti-friction bearings. Eccentric bearing bushing 17 for the pivotal axle (shown in chain-dotted lines in FIG. 1) is operatively connected to pulley 20 of shaft 21 which is journaled in housing 1 and passes through its center portion 2. The illustrated connection between bushing 17 and pulley 20 is endless belt 19 but it could be a chain or a rack-and-pinion drive. Shaft 21 is rotated by motor 22, which may be an electric or hydraulic motor, the rotation of shaft 22 being transmitted to eccentric bushing 17 by drive connection 19 so that the eccentric bushings are rotated. The eccentricity of the bearing bushings for axles 5 imparts to the tamping tools 6, 7 a compound motion having a vertical and a horizontal component, which provides very effective tamping of the ballast underneath ties 36 when the tamping tools are reciprocated towards each other.

Figure 3:
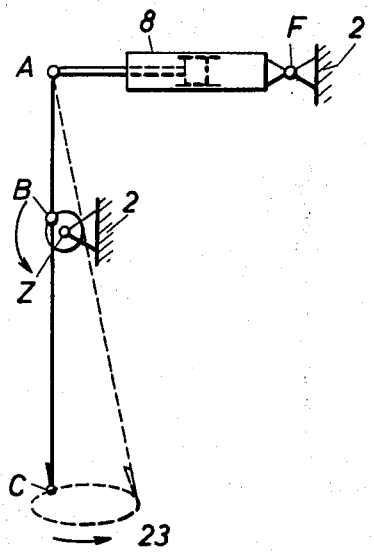

FIG. 3 schematically illustrates the drive and motion of each tamping tool. The tamping tool holder and jaw are indicated by the line A-B-C, A being the upper end of the tamping tool holder linked to the piston rod of hydraulic drive motor 8. The cylinder of the drive motor is linked to housing 2 at F. Pivoting axis B is coincident with the axis of axle 5. Rotation of bearing bushing 17 of axle 5 causes axis B to move in a circle about point Z which is the center of anti-friction bearings 18, 18. The lower end of the tamping tool jaw, i.e. point C, moves along elliptical path 23. This movement is combined with the circular movement imparted to the tamping tool by motor 8, which greatly facilitates the penetration of the tamping tool into the ballast.

Figure 4:
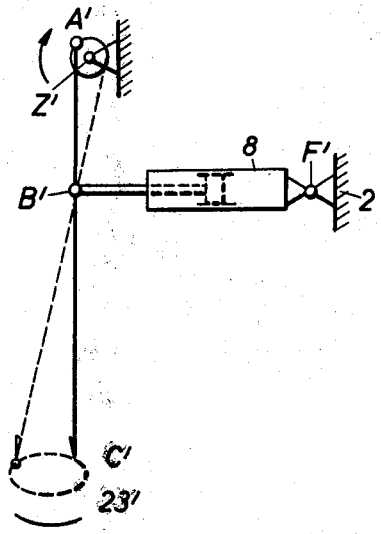

FIG. 4 schematically shows a modified arrangement producing an equivalent tamping tool movement. Line A'-B'-C' indicates the tamping tool holder and jaw but, in this embodiment, the piston rod of motor 8 is connected to intermediate point B', with the cylinder of the motor being linked at F' to housing 2, while pivotal axle 5, i.e. point A', is positioned at the upper end of the tamping tool holder, with center point Z' being fixedly mounted so that point A' moves in a circle upon rotation of the eccentric bearing bushing for the axle. Lower point C' again moves along elliptical path 23'.

The ratio between the lengths of AB (or A'B') to BC (or B'C') may be so chosen that path 23 (or 23') is either practically circular or that the larger diameter of the elliptical path runs vertically, in which case the vertical component of the motion is larger than its horizontal component.

Figure 7:
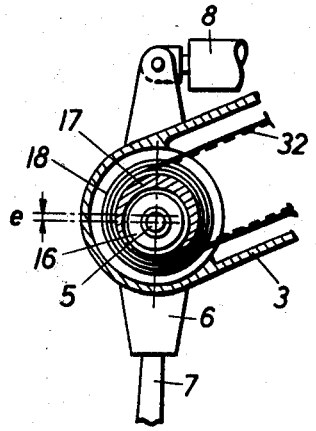
FIG. 7 is a section of the bearing of a tamping tool holder.

FIG. 7 shows a transverse section of the bearing for pivotal axle 5 for tamping tool holder 6. Eccentric bearing bushing 17 for the axle has an eccentricity *e* and anti-friction bearing 18 mount the bushing rotatably in the end of housing leg 3, anti-friction bearing 16 being interposed between the bearing bushing and axle 5. The illustrated drive connection in FIG. 7 is a toothed belt 32.

It will be apparent that the eccentric bearing for the pivotal axles of the tamping tools imparts a vibratory motion to the tools, which has a horizontal and a vertical component, thus improving the tamping effect on the ballast. The vertical component facilitates penetration of the tamping tool jaw into the ballast, particularly if the ballast bed is encrusted. This, in turn, improves the efficiency of the tamper because the time needed for penetration of the tamping tools into the ballast is considerably reduced.

Figure 6:
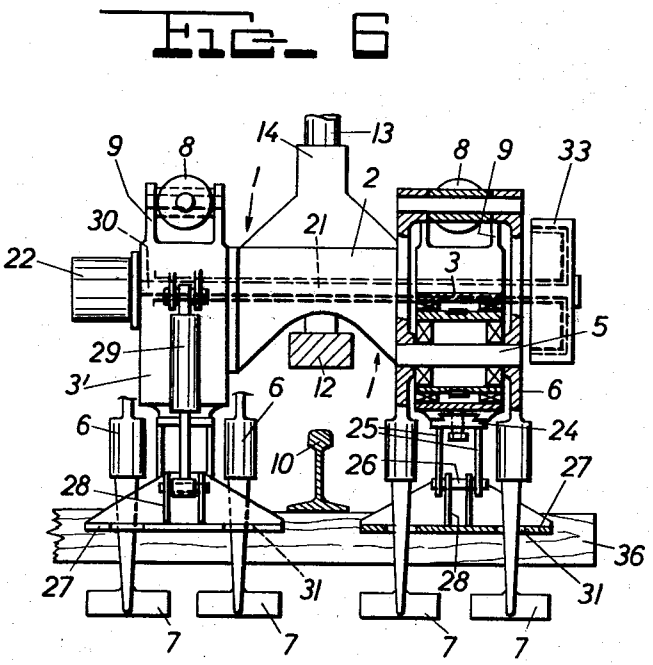
FIG. 6 is a side elevational view of the tamping tool unit of FIG. 5, partly in section.
Figure 5:
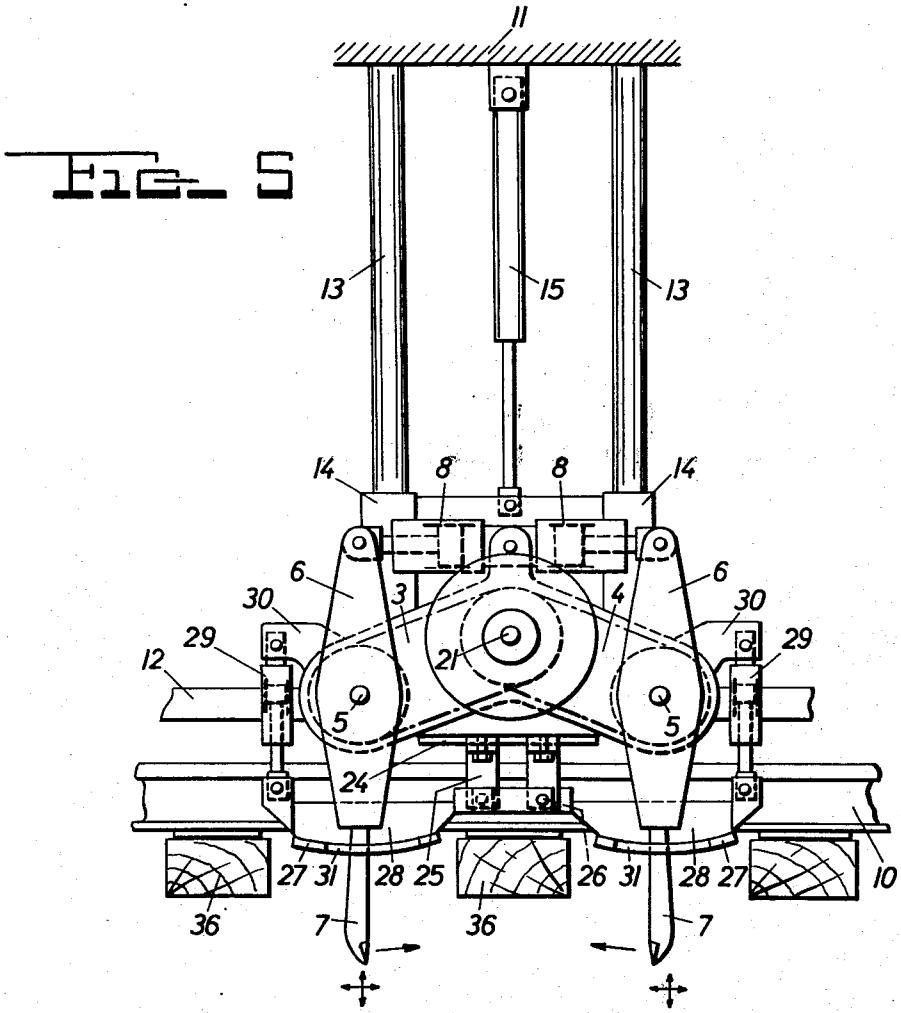
FIG. 5 is similar to FIG. 1 and shows a second embodiment of the invention.

FIGS. 5 and 6 show another embodiment of a tamping tool unit incorporating the principles of the present invention, like reference numerals in these figures designating like parts operating in a like manner to avoid redundancy in the description.

In this embodiment, carrier plate 24 is affixed to the underside of the legs of H-shaped housing 1 between the pairs of cooperating tamping tools. Brackets 25 for bolts 26 are affixed to the carrier plates, the bolts serving as pivotal axles for a ballast surface compacting device. This device comprises slightly arcuate compacting plate 27 arranged to engage the surface of the ballast in each crib. The compacting plate is welded or otherwise affixed to two stiffening elements 28, 28 which are mounted on bolt 26 at one of their ends while the free ends of the stiffening elements are linked to the piston rods of hydraulic motors 29 while the cylinders of motors 29 are linked to arms 30 extending from the outer ends of the legs 3, 4 of housing 1. Compacting plates 27 define guide slots 31 through which tamping tool jaws 7 extend and in which they are guided during their reciprocation.

In this manner, static pressure is applied against the surface of the ballast by compacting plates 27 at the same time that the vibratory and reciprocating tamping tools compact the ballast in depth, thus considerably increasing the tamping effect.

The tamping unit preferably comprises four pairs of cooperating tamping tools, two pairs of tools being arranged symmetrically with respect to rail 10 of the track, with track ties 36 being positioned between the cooperating tamping tools. Eccentric bearing bushing 17 are preferably driven so that diagonally opposite pairs of tamping tools simultaneously move up or down while the two other diagonally opposite pairs of tamping tools move synchronously and in a direction opposite to that of the first pairs of tools. This vibrates the ballast most intensively and thus produces very high compaction.

If desired, means may be provided for blocking vibration of the tamping tool holders during the vertical movement of the tamping tools out of the tamped ballast. This prevents the tamped ballast from being loosened again. This may be accomplished, for instance, by placing coupling 33 between motor 22 and drive shaft 21 so that the shaft may be disconnected from the motor. It may also be simply a switch shutting off operation of the drive motor. The coupling or switch are operated in response to the vertical movement of the tamping tools along guide columns 13, 13 by means of motor 15, drive shaft 21 for vibrating the tamping tools being rotated only during the down movement of the unit and while the tamping tool jaws are immersed in the ballast during the tamping operation.

What is claimed is:

1. A tamping tool unit for a ballast tamping machine, comprising 1. a pair of tamping tool holders;
2. drive means for pivoting the tamping tool holders towards and away from each other;
3. an axle pivotally supporting each tamping tool holder;
4. an eccentric bearing bushing rotatably mounted on the axle; and
5. further drive means for rotating the bearing bushing whereby a compound motion consisting of a vertical and a horizontal component is imparted to each tamping tool holder.

2. The tamping tool unit of claim 1, further comprising a housing, outer anti-friction bearing means mounted in the housing and supporting the eccentric bearing bushing for rotation in the housing, the eccentric bearing bushing having an eccentric axial bore, and inner anti-friction bearing means mounted in the eccentric axial bore and supporting the axle for rotation.

3. The tamping tool unit of claim 1, wherein the further drive means comprises a drive shaft, motor means for rotating the drive shaft, and transmission means connecting the eccentric bearing bushings of the tamping tool holders to the drive shaft whereby the rotating drive shaft rotates the bushings.

4. The tamping tool unit of claim 3, further comprising means for discontinuing rotation of the drive shaft.

5. The tamping tool unit of claim 1, wherein each tamping tool holder carries a tamping tool for immersion into a crib, and further comprising means for applying a static pressure to the surface of the ballast in the cribs wherein the tamping tools are immersed.

6. A tamping tool unit for a ballast tamping machine, comprising 1. a housing;
2. a pair of tamping tool holders mounted in the housing;
   a. each tamping tool holder carrying a tamping tool for immersion in a crib;

3. drive means for pivoting the tamping tool holders towards and away from each other;
4. an axle pivotally supporting each tamping tool holder;
5. an eccentric bearing bushing rotatably mounted on the axle;
6. further drive means for rotating the bearing bushing whereby a compound motion consisting of a vertical and horizontal component is imparted to each tamping tool holder;
7. an arcuate ballast compaction plate for applying a static pressure to the surface of the ballast in the cribs wherein the tamping tools are immersed,
   a. the compaction plate defining guide slots for the tamping tools enabling the tamping tool holders to pivot, and
   b. one end of the compaction plate being pivotally connected to the housing; and
8. a hydraulic motor cooperating with the other end of the compaction plate for applying pressure on the plate.

* * * * *